US005538463A

United States Patent [19]

Hasegawa et al.

[11] Patent Number: 5,538,463

[45] Date of Patent: Jul. 23, 1996

[54] APPARATUS FOR BEVELLING WAFER-EDGE

[75] Inventors: Fumihiko Hasegawa; Tatsuo Ohtani; Yasuyoshi Kuroda, all of Fukushima-ken, Japan

[73] Assignee: Shin-Etsu Handotai Co., Ltd., Tokyo, Japan

[21] Appl. No.: 156,829

[22] Filed: Nov. 24, 1993

[30] Foreign Application Priority Data

Nov. 26, 1992 [JP] Japan ..... 4-317041
Nov. 27, 1992 [JP] Japan ..... 4-318445

[51] Int. Cl.[6] ..... B24B 5/00

[52] U.S. Cl. ..... 451/254; 451/5

[58] Field of Search ..... 451/5, 6, 8, 9, 451/10, 11, 24, 72, 121, 44, 254, 255, 256, 375, 7; 356/375

[56] References Cited

U.S. PATENT DOCUMENTS

| | | | |
|---|---|---|---|
| 3,325,946 | 1/1967 | Lange | 451/121 |
| 3,798,843 | 3/1974 | Weatherell | 451/121 |
| 4,286,415 | 9/1981 | Loreto | 451/44 |
| 4,638,601 | 1/1987 | Steere | 451/6 |
| 4,693,038 | 9/1987 | Vetter | 451/6 |
| 4,999,954 | 3/1991 | Miyamoto | 451/5 |
| 5,094,037 | 3/1992 | Hakomori et al. | 451/11 |
| 5,177,901 | 1/1993 | Smith | 451/72 |
| 5,258,823 | 11/1993 | Akamatsu | 356/375 |

FOREIGN PATENT DOCUMENTS

| | | |
|---|---|---|
| 53-14554 | 2/1978 | Japan . |
| 62-37925 | 3/1987 | Japan . |

*Primary Examiner*—Bruce M. Kisliuk
*Assistant Examiner*—Andrew Weinberg
*Attorney, Agent, or Firm*—Oliff & Berridge

[57] ABSTRACT

An apparatus for bevelling the edge of a wafer, comprising a framework, a table rotatably mounted to the framework and capable of holding down the wafer, a buff rotatably mounted to the framework opposite the table and having a formed groove for bevelling the wafer edge, an air cylinder assembly mounted to the framework and pressing the buff by different forces on the orientation flat, the circular edge and the round joints of the wafer held down by the table, a sensor sensing the orientation flat, the circular edge and the round joints of the wafer held down by the table and producing corresponding signals, and a control controlling the air cylinder assembly to select between the forces in response to the signals. The apparatus may comprise a grooving cutter assembly removably held by the table, a lock locking the rotation of the table when the apparatus produces the formed groove in the buff, and a stopper stopping the air cylinder assembly and positioning the cutter assembly relative to the buff.

17 Claims, 10 Drawing Sheets

APPARATUS FOR BEVELLING WAFER-EDGE

BACKGROUND OF THE INVENTION

1. Field of the Invention

The present invention relates to an apparatus for bevelling the edge of a semiconductor wafer (hereinafter, referred to as a wafer) by polishing.

2. Description of the Related Art

FIG. 17 is a plan view of a main structure of a prior-art wafer edge bevelling machine. The main structure of the prior-art wafer edge bevelling machine comprises an arm 101 an intermediate of which is mounted on a pivot 102, a cylindrical buff 103 rotatably mounted to an end of the arm 101, an air cylinder assembly 109 having a piston rod in contact with the side of the other end of the arm 101 for pushing the buff 103 against the edge of a wafer W, and a suction turntable 110 positioned near the buff 103 and sucking the wafer W in place.

In operation, a driver (not shown) rotates the buff 103 at a high speed counterclockwise in FIG. 17, the air cylinder assembly 109 concurrently pushes the other end of the arm 101 by a fixed force F in the direction of an arrow F, and the suction turntable 110 is rotated at a low speed counterclockwise in FIG. 17. Thus, the buff 103 is pressed on the edge of the wafer W by a contact pressure $\sigma$ and edge the edge of the wafer W is edged.

As shown in FIG. 5, the edge of the wafer W generally comprises an orientation flat W1, a circular edge W2, and round joints W3 between the orientation flat W1 and the circular edge W2. Since radii of curvature R1(=∞), R2 and R3 of the orientation flat W1, the circular edge W2 and the round joints W3 have a relational expression: $R_3<R_2<R_1$, the areas C1, C2 and C3 of spots of contact between the buff 103 and each of the orientation flat W1, the circular edge W2 and the round joints W3 have a relational expression: C1<C2<C3.

Therefore, when the air cylinder assembly 109 pushes the side of the other end of the arm 101 by the fixed force F, the contact pressures $\sigma_1$, $\sigma_2$ and $\sigma_3$ produced on the orientation flat W1, the circular edge W2 and the round joints W3 are reduced in response to the radii of curvature R1, R2 and R3 (i.e., $\sigma_1<\sigma_2<\sigma_3$). In particular, the round joints W3 receive an excessive contact pressure so that the edges of the round joints W3 may have an abnormally strong grip on the buff 103 to abnormally polish or bevel the round joints W3.

Thus, the force F of the air cylinder assembly 109 must be so small that the round joints W3 will not have the abnormally strong grip on the buff 103. This reduces the productivity in the wafer edge bevelling.

Since the contact pressures $\sigma_1$, $\sigma_2$ and $\sigma_3$ on the orientation flat W1, the circular edge W2 and the round joints W3 are different, the prior-art wafer edge bevelling machine cannot have an optimal uniform finish precision over the edge of the wafer W.

Since bevelling the edges of many wafers W wears a formed groove 103*a* in the buff 103 for bevelling the edge of wafer W to deteriorate or deform the section of the formed groove 103*a*, i.e., produce a permanent set in fatigue on the section of the formed groove 103*a*, a new formed groove 103*a* must be produced at a convenient time.

Conventionally, there are two methods of producing the formed groove in the buff. It is a first method that the buff 103 is removed from the wafer edge bevelling machine and then worked by a dedicated lathe to provide a new formed groove 103*a*. It is a second method that as shown in FIG. 18 a rotating shaft 110R of the wafer suction turntable 110 has a radially extending. Cutter 131 normally installed thereon and the cutter 131 is vertically moved and produces the formed groove 103*a* in the buff 103, if necessary.

In the first method, the attachment and the detachment of the buff 103 to and from the wafer edge bevelling machine are troublesome and the installation precision of the buff 103 to the wafer edge bevelling machine is problem. In the second method, the wafer edge bevelling machine produces the formed groove 103*a* while the rotating shaft 130 has the buff 103 normally installed thereon, so that the installation precision of the buff 103 on the rotating shaft 130 is not problem. However, the cutter 131 is normally exposed to a slurry 113 containing a polishing material during wafer edge bevelling because of the normal installation of the cutter 131 on the rotating shaft 130, so that the cutter 131 must be made of a special protective material, e.g., an expensive and difficultly available ceramic material. Therefore, the kinds of available cutters are restricted.

SUMMARY OF THE INVENTION

Therefore, an object of the present invention is to provide an apparatus for bevelling the wafer edge which prevents a wafer from having an abnormally strong grip on a buff, provides an optimal bevelling precision over the wafer edge, and increases the productivity in the wafer edge bevelling.

In order to achieve this object, a first aspect of the present invention comprises, in an apparatus for bevelling the edge of a wafer, the edge of the wafer including a circular edge having a radius of curvature, an orientation flat separate from the circular edge and having an infinite radius of curvature, and round joints between the circular edge and the orientation flat each having a radius of curvature smaller than the radius of curvature of the circular edge, a framework, a table rotatably mounted to the framework and capable of holding down the wafer, a buff rotatably mounted to the framework opposite the table and having a formed groove for bevelling the edge of the wafer, means, mounted to the framework, for pressing the buff to the orientation flat, the circular edge and the round joints of the wafer held down by the table, a sensor sensing the orientation flat, the circular edge and the round joints of the wafer held down by the table and producing corresponding signals, and a control controlling the pressing means to select different forces in response to the signals.

In the first aspect of the present invention, the forces may comprise a first forge by which the pressing means presses the buff on the orientation flat, a second forge by which the pressing means presses the buff on the circular edge, and a third force by which the pressing means presses the buff on the round joints. The first, second and third forces have such a relation that the first forge is largest, the second force is intermediate and the third forge is smallest.

In the first aspect of the present invention, the pressing means may comprise an air cylinder assembly, the control may comprise a pneumatic control circuit and an electronic central processing unit. The pneumatic control circuit comprises a compressed air source and a solenoid operated valve. The solenoid operated valve changes the pressure of compressed air supplied from the compressed air source to the air cylinder assembly into three different pressures in response to the forges under the control of the electronic central processing unit.

In the first aspect of the present invention, the sensor may comprise a photo-sensor having a pair of a light-emitting element and a light-receiving element arranged opposite each other through the wafer held down by the table.

In the first aspect of the present invention, the photo-sensor is positioned relative to the table so that the area of a cross section of a beam of light received by the light-receiving element is largest when the center of the orientation flat passes through a beam of light emitted from the light-emitting element. The signals have voltages proportional to the area.

In the first aspect of the present invention, the control may determine the forges to produce substantially the same contact pressure on a point of bevelling between the edge surface of the formed groove and the edge of the wafer over the edge of the wafer. Thus, the apparatus uniformly bevels the orientation flat, the circular edge and the round joints by the substantially equal contact pressures and insures an optimal wafer edge bevelling precision over the wafer edge to increase the productivity in the bevelling.

Another object of the present invention is to provide an apparatus for easily and precisely producing a formed groove in the buff for bevelling the wafer edge, does not degrade the installation precision of the buff and requires no measure for a polishing slurry.

In order to achieve this object, a second aspect of the present invention comprises, in an apparatus for bevelling the edge of a wafer, the edge of the wafer including a circular edge having a radius of curvature, an orientation flat separate from the circular edge and having an infinite radius of curvature, and round joints between the circular edge and the orientation flat each having a radius of curvature smaller than the radius of curvature of the circular edge, a framework, an arm an intermediate of which is pivotally mounted to the framework, a table rotatably mounted to one end of the arm and capable of holding down the wafer, a buff rotatably mounted to the framework opposite the table and having a formed groove for bevelling the edge of the wafer, a pusher pushing the other end of the arm in a direction of the rotation of the arm in which the one end of the arm approaches the buff, a grooving cutter assembly capable of being removably held by the table and of producing the formed groove in the buff, a lock locking the rotation of the table when the apparatus for bevelling the edge of the wafer produces the formed groove in the buff, and a stopper mounted to the framework and stopping the rotation of the arm, the stopper positioning the grooving cutter assembly relative to the buff in cooperation with the pusher.

In the second aspect of the present invention, the apparatus may further comprise a return spring urging the arm in a direction of the rotation of the arm in which the wafer held by the table is moved away from the buff. The pusher may comprise an air cylinder assembly having a piston rod in contact with the other end of the arm. The stopper may be opposite the pusher through the arm and movable in the direction of the piston rod. The stopper produces a counter-force having a direction in alignment with the direction of a push of the piston rod.

In the second aspect of the present invention, the apparatus may further comprise the pusher pushing the arm by different forges to cause the buff to press by substantially the same contact pressure the orientation flat, the circular edge and the round joints of the wafer held down by the table, a sensor sensing the orientation flat, the circular edge and the round joints of the wafer held down by the table and producing corresponding signals, and a control controlling the pusher to select between the forces in response to the signals.

In the second aspect of the present invention, the forges may comprise a first forge by which the arm presses the buff on the orientation flat, a second force by which the arm presses the buff on the circular edge, and a third force by which the arm presses the buff on the round joints. The first, second and third forces have such a relation that the first force is largest, the second force is intermediate and the third force is smallest.

In the second aspect of the present invention, the pusher may comprise an air cylinder assembly, the control comprises a pneumatic control circuit and an electronic central processing unit, the pneumatic control circuit comprising a compressed air source and a solenoid operated valve. The solenoid operated valve changes the pressure of compressed air supplied from the compressed air source to the air cylinder assembly into three different pressures in response to the forges under the control of the electronic central processing unit.

In the second aspect of the invention, the buff need not be removed when the apparatus originally produces or renews the formed groove in the buff so that the grooving does not adversely affect the installation precision of the buff. The stopper precisely stops the rotation of the arm to precisely position the grooving cutter assembly to precisely determine a biting depth of the grooving cutter assembly in the buff. This insures the precise shaping of the formed groove. The table holds the grooving cutter assembly in place only when the apparatus shapes the formed groove in the buff, so that the grooving cutter assembly is not exposed to a polishing slurry. Consequently, the apparatus eliminates the need for measures for the slurry and the need for the employment of a grooving cutter of an expensive material. The table can quickly precisely hold the grooving cutter assembly in place in substantially the same manner as the table holds the wafer, so that the apparatus can easily efficiently produce the formed groove in the buff.

Other objects, features and advantages of the present invention will be apparent from a consideration of the following description, taken in connection with the accompanying drawing.

DETAILED DESCRIPTION OF THE PREFERRED EMBODIMENTS

Figure 1:
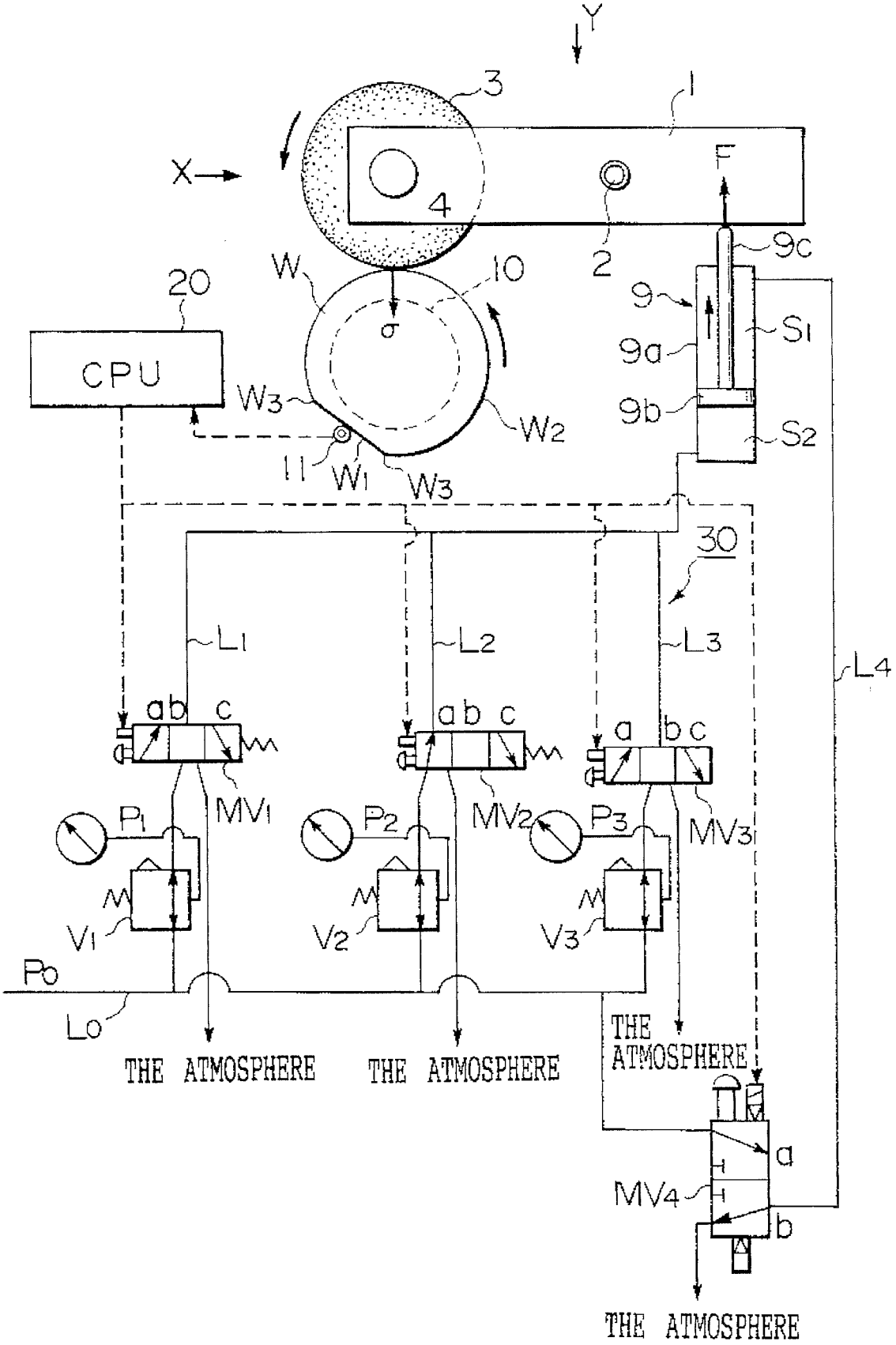
FIG. 1 is a pneumatic circuit diagram of a wafer edge bevelling machine according to a first embodiment of the present invention.
Figure 2:
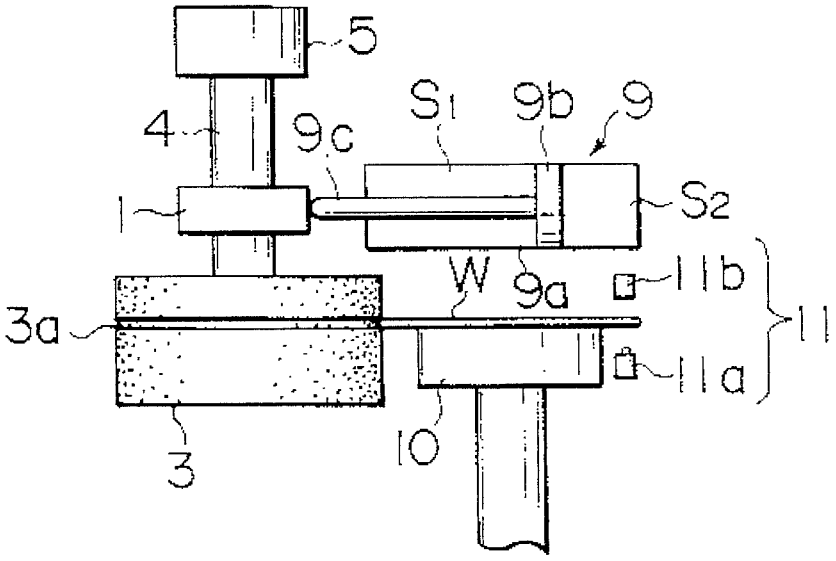
FIG. 2 is a view of the wafer edge bevelling machine in the direction of an arrow X in FIG. 1.
Figure 3:
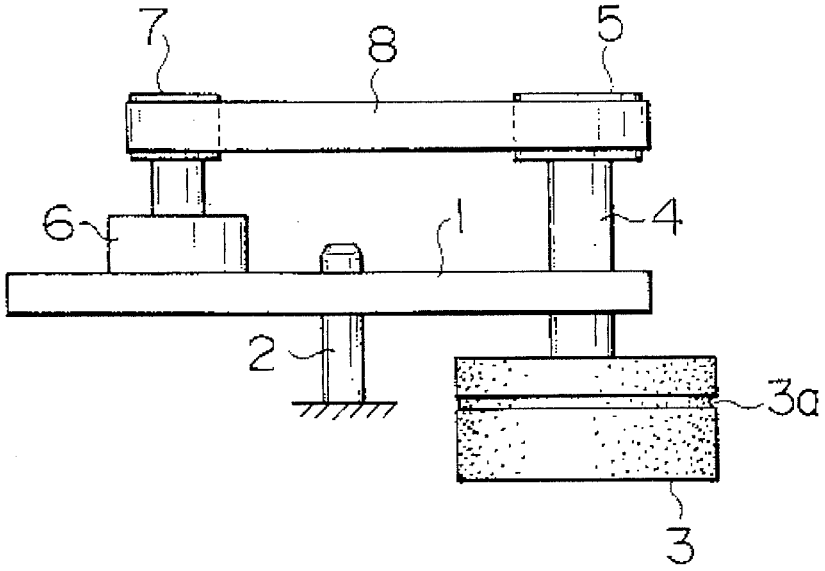
FIG. 3 is a view of the wafer edge bevelling machine in the direction of an arrow Y in FIG. 1.
Figure 4:
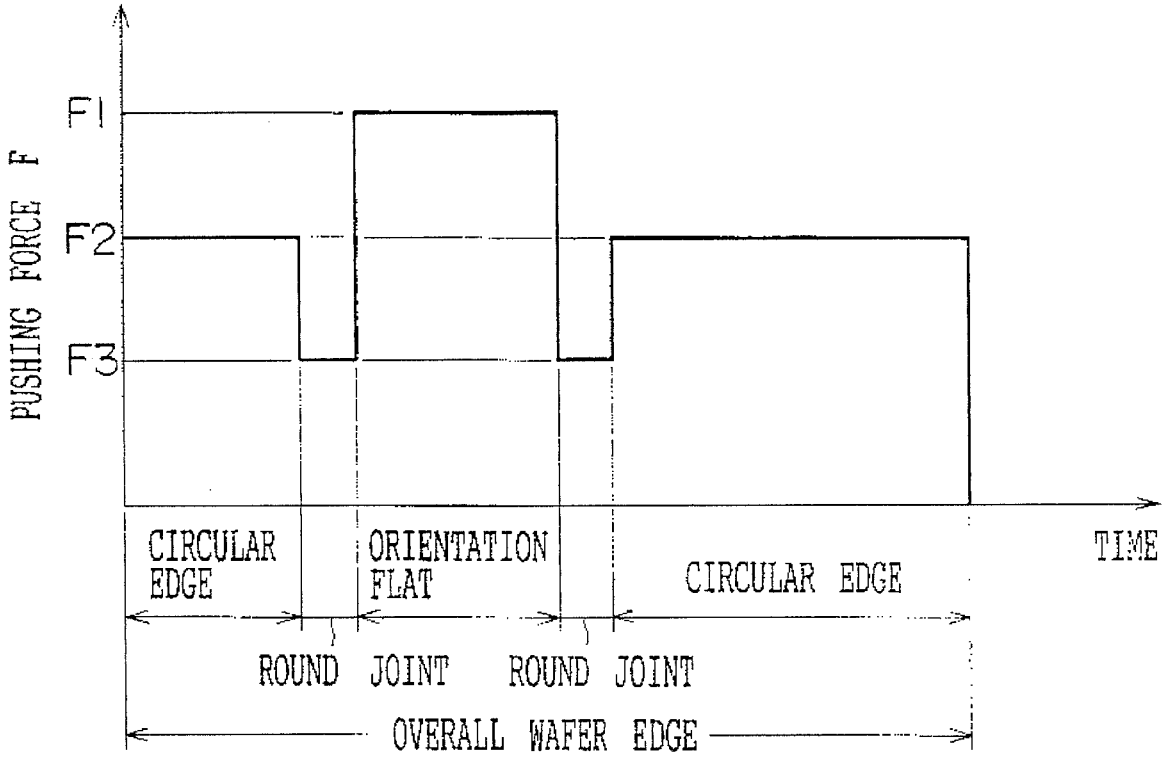
FIG. 4 is a timing chart illustrative of changes in a pushing force F with time.

Embodiments of the present invention will be described with reference to the drawings hereinafter. FIGS. 1 to 4 show a wafer edge bevelling machine according to a first embodiment of the present invention. FIG. 1 shows a pneumatic circuit of a wafer edge bevelling machine according to a first embodiment of the present invention. FIG. 2 is a view of the wafer edge bevelling machine in the direction of an arrow X in FIG. 1. FIG. 3 is a view of the wafer edge bevelling machine in the direction of an arrow Y in FIG. 1. FIG. 4 is a timing chart illustrative of changes in a pushing force F with time.

In FIGS. 1 to 3, an arm is indicated at 1. An intermediate of the arm 1 is mounted on a pivot 2 which is fixed to a framework (not shown) of the wafer edge bevelling machine. The front end of the arm 1 has a vertical rotatable shaft 4. The rotatable shaft 4 has an installed cylindrical buff 3 of urethane foam. As shown in FIGS. 2 and 3, the outer cylindrical surface of the buff 3 has an annular formed groove 3*a*. The buff 3 is not removed from the rotatable shaft 4 in renewing the formed groove 3*a* in the buff 3. The buff 3 may alternatively be removed from the rotatable shaft 4 in renewing the formed groove 3*a* in the buff 3.

As shown in FIGS. 2 and 3, the upper end of the rotatable shaft 4 extends upward through the arm 1 and has a pulley 5 fixed thereto.

A rear end of the arm 1 has an electrical motor 6 mounted thereon. The vertical output shaft of the motor 6 has a pulley 7. A belt 8 is extended between the pulleys 5 and 7 and passes over the rims of the pulleys 5 and 7. An air cylinder assembly 9 is located to a side edge surface of the rear end of the arm 1 for rotating the arm 1 counterclockwise in FIG. 1. A piston 9*b* of the air cylinder assembly 9 separates the interior of a cylinder 9*a* into chambers S1 and S2. The front end of a piston rod 9C fixed to the piston 9*b* is in contact with the side edge surface of the arm 1 as shown in FIGS. 1 and 2.

As best shown in FIG. 2, a suction table 10 is positioned horizontally near the buff 3 and rotatable. The top surface of the suction table 10 sucks in place a wafer W the edge of which are to be bevelled. A driver (not shown) rotates the suction table 10.

As shown in FIG. 2, a photo-sensor 11 sensing the orientation flat W1 of the wafer W (see FIG. 5) is positioned near the suction table 10. The photo-sensor 11 comprises a pair of a light-emitting unit 11*a* and a light-receiving unit 11*b* arranged opposite each other through the wafer W. The light-receiving unit 11*b* receives a beam of light from the light-emitting unit 11*a* to produce a sensing signal of a voltage proportional to the intensity of the light.

When the circular edge W2 of the wafer W (see FIG. 5) passes through the photo-sensor 11, the circular edge W2 completely intercepts the beam of light from the light-emitting unit 11*a*. On the other hand, when the orientation flat W1 passes through the photo-sensor 11, part or all of the light from the light-emitting unit 11*a* reaches the light-receiving unit 11*b*, so that the photo-sensor 11 senses the orientation flat W1. When the center of the orientation flat W1 enables the beam of light from the light-emitting unit 11*a* to pass to the light-receiving unit 11*b*, the photo-sensor 11 produces a sensing signal of the peak voltage.

A controller 20 comprising an electronic central processing unit (CPU) receives the sensing signal from the photo-sensor 11 and determines the center of the orientation flat W1 from the peak voltage of the sensing signal. The determination of the center of the orientation flat W1 determines the positions of the orientation flat W1, the circular edge W2 and the round joints W3 (see FIG. 5) since the dimensions of the orientation flat W1 is known to the wafer edge bevelling machine.

In the first embodiment, the photo-sensor 11 distinctively senses the orientation flat W1, the circular edge W2 and the round joints W3 and the wafer edge bevelling machine comprises a control selecting a corresponding one of pressures P1, P2 and P3 (P1>P2>P3) of compressed air supplied to the air cylinder assembly 9 in response to the sensing signals from the photo-sensor 11. As shown in FIG. 1, the control comprises a pneumatic control circuit 30 and the CPU 20.

The pneumatic control circuit 30 comprises a reference pressure line L0 communicating with a plenum of an air compressor (not shown). The reference pressure line L0 has three parallel pairs of a pressure control valve V1 and a solenoid operated valve MV1 connected in series to the pressure control valve V1, a pressure control valve V2 and a solenoid operated valve MV2 connected in series to the pressure control valve V2, and a pressure control valve V3 and a solenoid operated valve MV3 connected in series to the pressure control valve V3. The pressure control valve V1 reduces the reference pressure P0 to the pressure P1. The pressure control valve V2 reduces the reference pressure P0 to the pressure P2. The pressure control valve V3 reduces the reference pressure P0 to the pressure P3. The solenoid operated valves MV1, MV2 and MV3 are of a three-position three-port valve switched between positions a, b and c under control of the CPU 20. When the solenoid operated valves MV1, MV2 and MV3 are in the positions a, compressed air of the pressures P1, P2 and P3 is supplied to the chamber S2 of the air cylinder assembly 9 through reduced-pressure lines L1, L2 and L3. When the solenoid operated valves MV1, MV2 and MV3 are in the positions b (i.e. neutral positions), the solenoid operated valves MV1, MV2 and MV3 interrupt passages (i.e. supplies and discharges) of compressed air of the pressures P1, P2 and P3. When the solenoid operated valves MV1, MV2 and MV3 are in the positions c, the solenoid operated valves MV1, MV2 and MV3 enable compressed air to be discharged from the chamber S2 of the air cylinder assembly 9 to the atmosphere.

A pressure line L4 is connected to the chamber S1 of the air cylinder assembly 9 and to the reference pressure line L0 or the atmosphere. The pressure line L4 has a solenoid operated valve MV4 provided therein. The solenoid operated valve MV4 is a two-position two-port valve controlled by the CPU 20. When the solenoid operated valve MV4 is in the position a, the pressure P0 is supplied from the reference pressure line L0 to the chamber S1 of the air cylinder assembly 9. On the other hand, when the solenoid operated valve MV4 is in the position b, air is discharged from the chamber S1 to the atmosphere.

Operation of the wafer edge bevelling machine according to the first embodiment will be described hereinafter.

The rotatable shaft 4 and the buff 3 are rotated at a high speed counterclockwise in FIG. 1. On the other hand, the suction table 10 has sucked the wafer W, and the photosensor 11 sensed the positions of the orientation flat W1, the circular edge W2 and the round joints W3, and the CPU 20 has stored data of these positions. The motor 6 is moved to transmit a torque to the rotatable shaft 4 by means of the pulley 7, the belt 8 and the pulley 5. The driver (not shown) rotates the suction table 10 and the wafer W counterclockwise in FIG. 1.

When the air cylinder assembly 9 drives the piston rod 9*c* to push the side edge surface of the rear end of the arm 1 by the force F in the direction of the arrow F, the arm 1 receives a counterclockwise moment about the pivot 2 to push the buff 3 against the edge of the wafer W by the contact pressure $\sigma$ so that the edge surface of the formed groove 3*a* in the buff 3 bevels the edge of the wafer W. In an actual wafer edge bevelling, the wafer edge bevelling machine supplies a slurry containing a polishing material to the beveled edge of the wafer W.

The CPU 20 switches between the pneumatic pressures P1, P2 and P3 supplied to the air cylinder assembly 9 in response to the sensing signals from the photo-sensor 11 to switch between the forces F1, F2 and F3 having a relational expression: F1>F2>F3 and applied to the arm 1 (see FIG. 4) so that the three contact pressures $\sigma_1$, $\sigma_2$ and $\sigma_3$ on the orientation flat W1, the circular edges W2 and the round joints W3 are substantially equal.

Figure 5:
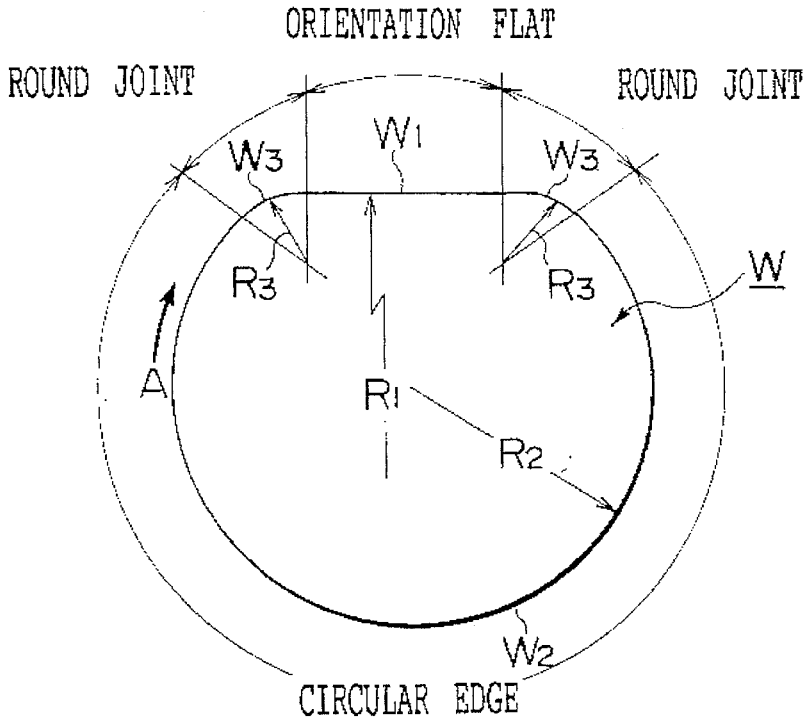
FIG. 5 is a plan view of a wafer.

Specifically, wafer edge bevelling machine, as shown in FIG. 5, bevels the edge of the wafer W clockwise from the point A on the circular edge W2 in FIG. 5. First, since a point of bevelling is within the circular edge W2, the CPU 20 causes the solenoid operated valve MV2 to assume the position a and the solenoid operated valves MV1, MV3 and MV4 to assume the positions b. Thereby, the pressure control valve V2 reduces the reference pressure P0 from reference pressure line L0 to the intermediate pressure P2 between P1 and P3. The pressure P2 is supplied to the chamber S2 of the air cylinder assembly 9 through the reduced-pressure line L2 to extend the piston rod 9*c* outside the cylinder 9*a*. Air is concurrently discharged from the chamber S1 of the air cylinder assembly 9 to the atmosphere through the pressure line L4.

The piston rod 9*c* is extended to push the side edge surface of the front end of the arm 1 by the intermediate force F2 between the forces F1 and F3 shown in FIG. 4. The buff 3 is pressed by the contact pressure $\sigma_2$ on the circular edge W2 to bevel the circular edge W2 by polishing.

When the suction table 10 is rotated to transfer the point of bevelling to an round joint W3, the CPU 20 switches the position of the solenoid operated valve MV3 to the position a and the position of the solenoid operated valve MV2 to the position b and continues the other solenoid operated valves MV3 and MV4 to assume the positions b. Thereby, the pressure control valve V3 reduces the reference pressure P0 from the reference pressure line L0 to the lowest pressure P3. The pressure P3 is supplied to the chamber S2 of the air cylinder assembly 9 through the reduced-pressure line L3 to extend the piston rod 9*c* out side the air cylinder 9*a*. Air is concurrently discharged from the chamber S1 of the air cylinder assembly 9 to the atmosphere through the pressure line L4.

The piston rod 9*c* is extended to push the side edge surface of the front end of the arm 1 by the smallest force F3 of the forces F1, F2 and F3 shown in FIG. 4. The buff 3 is pressed by the contact pressure $\sigma_1$ on the round joint W3 to bevel the edge of the round joint W3.

When the suction table 10 is then rotated to transfer the point of bevelling to the orientation flat W1, the CPU 20 switches the position of the solenoid operated valve MV1 to the position a and the position of the solenoid operated valve MV3 to the position b and continues the other solenoid operated valves MV2 and MV4 to assume the positions b. The pressure control valve V1 then reduces the reference pressure P0 from the reference pressure line L0 to the highest pressure P1 of the reduced pressures P1, P2 and P3. The pressure P1 is supplied to the chamber S2 of the air cylinder assembly 9 through the pressure line L1 to extend the piston rod 9*c*. Compressed air is concurrently discharged from the chamber S1 of the air cylinder assembly 9 to the atmosphere through the pressure line L4.

The piston rod 9*c* is extended to push the side edge surface of the rear end of the arm 1 by the largest force F1 of the forces F1, F2 and F3 shown in FIG. 4. The buff 3 is then pressed by the contact pressure $\sigma_1$ on the orientation flat W1 to bevel the edge of the orientation flat W1.

The suction table 10 is subsequently rotated to transfer the point of bevelling to the other round joint W3. The buff 3 is then pressed by the contact pressure $\sigma_3$ on the other round joint W3 to bevel the other round joint W3. The suction table 10 is subsequently rotated to again transfer the point of bevelling to the circular edge W2. The arm 1 is rotated by the force F2 in the manner described above. The buff 3 is pressed by the contact pressure $\sigma_2$ on the circular edge W2 to bevel the circular edge W2. When the suction table 10 is rotated to return the point of bevelling to the point A, the wafer edge bevelling machine finishes bevelling the edge of the wafer W.

For example, when the Wafer edge bevelling machine bevels the edge of the wafer W with a 8-inch diameter by means of the buff 3 with a 150-mm radius and the respective radii R1, R2 and R3 of curvature of the orientation flat W1, the circular edge W2 and the round joints W3 are $\infty$, 100 mm and 5 mm, the ratios between the forces F1, F2 and F3 are selected to be 30:13:1 so that the contact pressures $\sigma_1$, $\sigma_2$ and $\sigma_3$ are substantially equal.

Thus, the wafer edge bevelling machine uniformly bevels the orientation flat W1, the circular edge W2 and the round joints W3 by the substantially equal contact pressures and insures an optimal wafer edge bevelling precision over the edge of the wafer W to increase the productivity in the bevelling.

The first embodiment has the structure of moving the buff 3 to the wafer W for bevelling the edge of the wafer W. However, an alternative embodiment of the present invention may have a structure of moving the wafer W to the buff 3.

Figure 6:
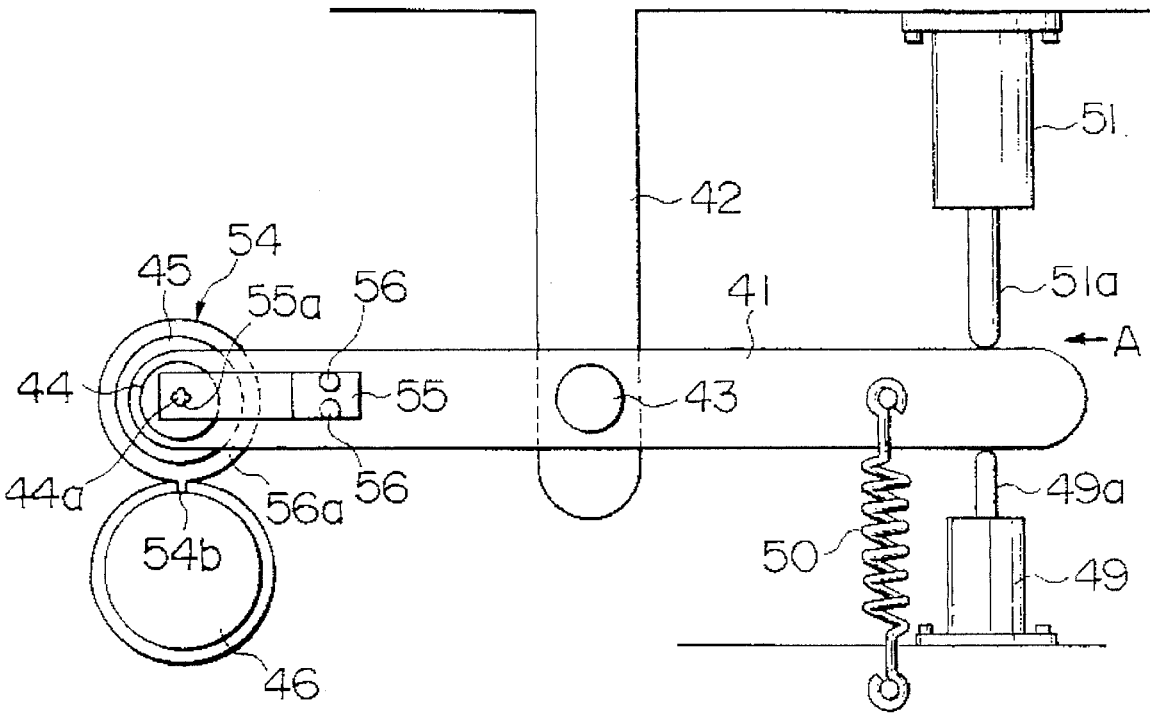
FIG. 6 is a plan view of a wafer edge bevelling machine having a cutter for producing a formed-groove in a buff according to a second embodiment of the present invention.
Figure 7:
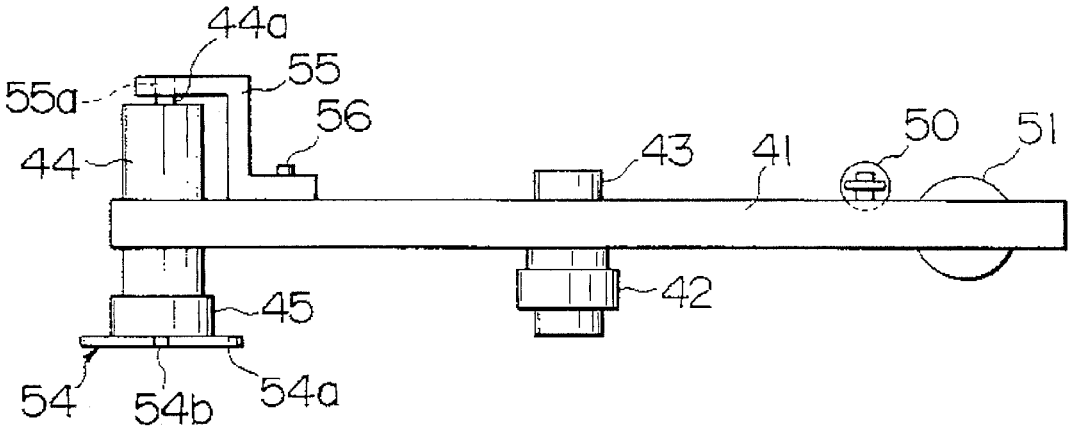
FIG. 7 is a front elevation of the wafer edge bevelling machine of FIG. 6.
Figure 8:
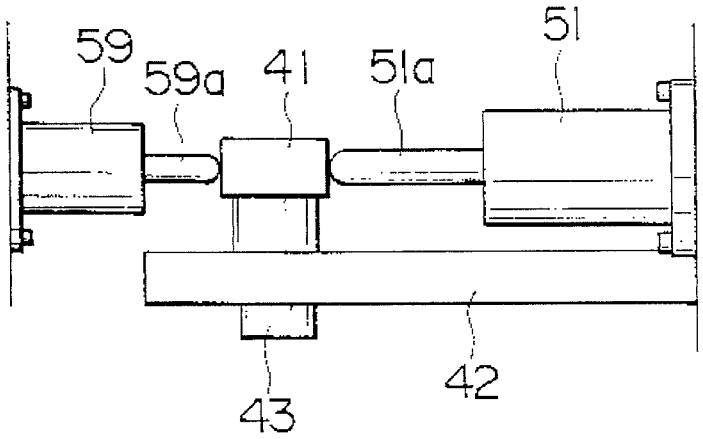
FIG. 8 is a right elevation of the wafer edge bevelling machine of FIG. 6 in the direction of an arrow A in FIG. 6.
Figure 9:
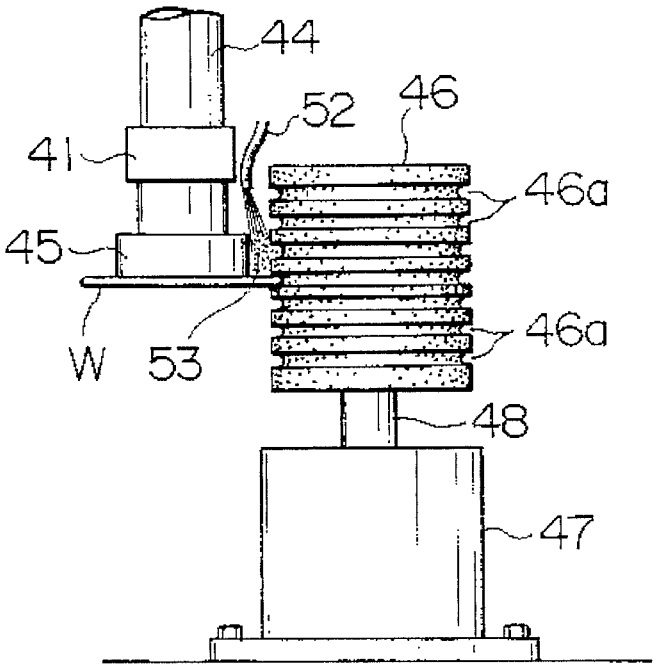
FIG. 9 is a left elevation of the wafer edge bevelling machine of FIG. 6, showing a state of bevelling the wafer edge.

FIGS. 6 to 16 show a wafer edge bevelling machine having a cutter for producing a formed-groove in a buff according to a second embodiment of the present invention. FIG. 6 is a plan view of a wafer edge bevelling machine according to the second embodiment of the present invention. FIG. 7 is a front elevation of the wafer edge bevelling machine of FIG. 6. FIG. 8 is a right elevation of the wafer edge bevelling machine of FIG. 6 in the direction of an arrow A in FIG. 6. FIG. 9 is a left elevation of the wafer edge bevelling machine of FIG. 6, showing a state of bevelling the wafer edge.

In FIGS. 6 to 9, an arm is indicated at 41. An intermediate of the arm 41 is mounted on a pivot 43 fixed to the front end of a support rod 42 extending from a fixed framework of the wafer edge bevelling machine. The front end of the arm 41 has an electrical motor 44 mounted atop it and a rotatable suction table 45 mounted on the underside thereof and rotated by the motor 44. A vacuum source (not shown) supplies a negative pressure to the underside of the suction table 45. The underside of the suction table 45 sucks the wafer W or a grooving cutter assembly 54 (see, e.g., FIGS. 7 and 10).

A cylindrical buff 46 of urethane foam is installed to an output shaft 48 of a driver 47 near the suction table 45. As shown in FIG. 9, the outer cylindrical surface of the buff 46 has seven annular formed grooves 46*a* vertically arranged for bevelling the wafer edge. Each of the formed grooves 46*a* has a cross section corresponding to the cross section of the edge to be bevelled of the wafer W. The buff 46 is not removed from the output shaft 48 in renewing the formed groove 46*a* in the buff 46. The driver 47 rotates the buff 46 at a predetermined speed and vertically moves the buff 46.

A piston rod 49*a* of an air cylinder assembly 49 fixed to the framework of the wafer edge bevelling machine pushes the side edge surface of the rear end of the arm 41. The rear end of the arm 41 is connected with one end of a return spring 50 in the form of a tension coil spring, so that the arm 41 is continuously urged in a direction in which the wafer W is moved away from the buff 46 (i.e. clockwise in FIG. 6). The air cylinder assembly 49 extends the piston rod 49*a* to rotate the arm 41 about the pivot 43 counterclockwise in FIG. 6 and as shown in FIG. 9 press the wafer W sucked by the suction table 45 by a predetermined force on the buff 46 during bevelling of the wafer edge. It is possible that the air cylinder assembly 49 has substantially the same structure as the air cylinder assembly 9 of the first embodiment of the present invention. That is, the air cylinder assembly 49 may have three output pressures corresponding to the three output pressures P1, P2 and P3 in bevelling the wafer edge.

Opposite the air cylinder assembly 49 through the arm 41, a stopper 51 in the form of an air cylinder assembly having a piston rod 51*a* is fixed to the framework of the wafer edge bevelling machine in order to position the tip of a cemented carbide tipped tool 54*b* of a grooving cutter assembly 54 relative to the outer cylindrical surface of the buff 46. The piston rod 51*a* of the stopper 51 is aligned with the piston rod 49*a* of the air cylinder assembly 49. Therefore, when the stopper 51 operates as shown in FIG. 6, the arm 41 is rigidly precisely positioned at right angle to the axis of the support rod 42.

In bevelling the edge of the wafer W, the driver 47 rotates the buff 46 at a high speed. On the other hand, the suction table 45 is rotated at a low speed by the motor 44 and concurrently receives the negative pressure, so that the suction table 45 rotates the wafer W at the low speed while sucking the wafer W. In this state, when the air cylinder assembly 49 has the same structure as the air cylinder assembly 9, the air cylinder assembly 49 extends the piston rod 49*a* by predetermined distances to push the side edge surface of the rear end of the arm 41 by the forces corresponding to the forces F1, F2 and F3 to rotate the arm 41 about the pivot 43 against the force of the return spring 50 counterclockwise in FIG. 6. The edge of the wafer W sucked by the suction table 45 is pressed on the edge surface of one of the formed groove 46*a* in the buff 46 while the motor 44 rotates the suction table 45 at the low speed.

When the edge of the wafer W is pressed on the edge surface of the one of the formed grooves 46*a* and a nozzle 52 supplies a slurry 53 containing a polishing material to the point of bevelling of the edge of the wafer W, a relative sliding between the edge of the wafer W and the edge surface of the one of the formed groove 46*a* and the polishing operation of the slurry 53 together bevel the edge of the wafer W.

Figure 12:
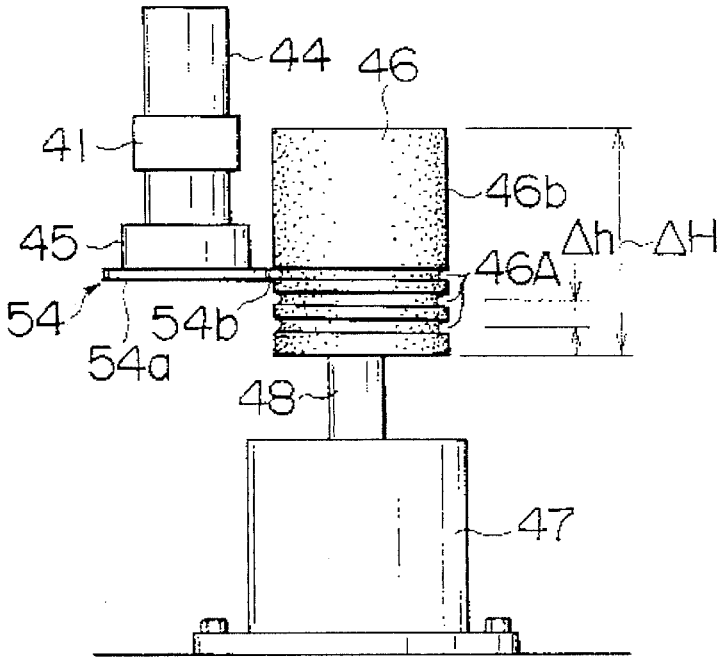
FIG. 12 is the left elevation of the wafer edge bevelling machine, showing a state of producing formed grooves in the outer cylindrical surface of the buff.

Bevelling the edges of many wafers W produces a permanent set in fatigue in the edge surfaces of the formed grooves 46*a*, so that the shape of the cross section of each formed groove 46*a* becomes to disagree from a target shape of the cross section of the edge of the wafer W. When the formed grooves 46*a* have failed, the wafer edge bevelling machine, as shown in FIG. 12, renews the formed grooves 46*a* in the buff 46 by means of the grooving cutter assembly 54.

Figure 10:
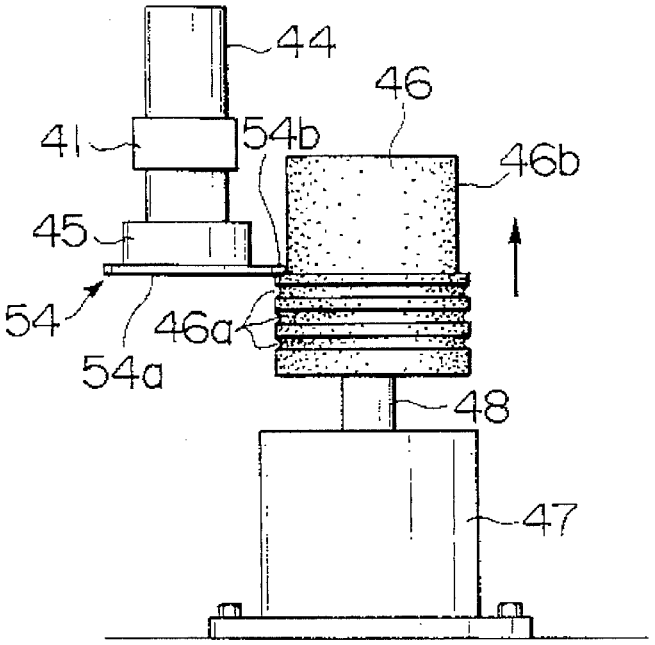
FIG. 10 is the left elevation of the wafer edge bevelling machine, showing a state of smoothing the outer cylindrical surface of the buff.

The process of renewing the formed-grooves 46*a* in the buff 46 will be described with reference to FIGS. 10–12 hereinafter. During renewal of the formed grooves, the wafer edge bevelling machine interrupts bevelling the edge of the wafer W and the supply of the slurry 53 by the nozzle The wafer suction table 45 sucks the grooving cutter assembly 54 while the output shaft 48 of the driver 47 has the buff 46. As shown in FIGS. 6 and 7, a locking jig 55 fastened by means of bolts 56 to the front end of the arm 41 locks the rotation of the suction table 45 during renewal of the formed grooves 46*a*. As best shown in FIG. 6, a rectangular hole 55*a* in the front end of the locking jig 55 fits a rectangular end of the output shaft 44*a* of the motor 44 to lock the rotation of the output shaft 44*a* of the motor 44 and therefore the suction table 45.

Figure 13:
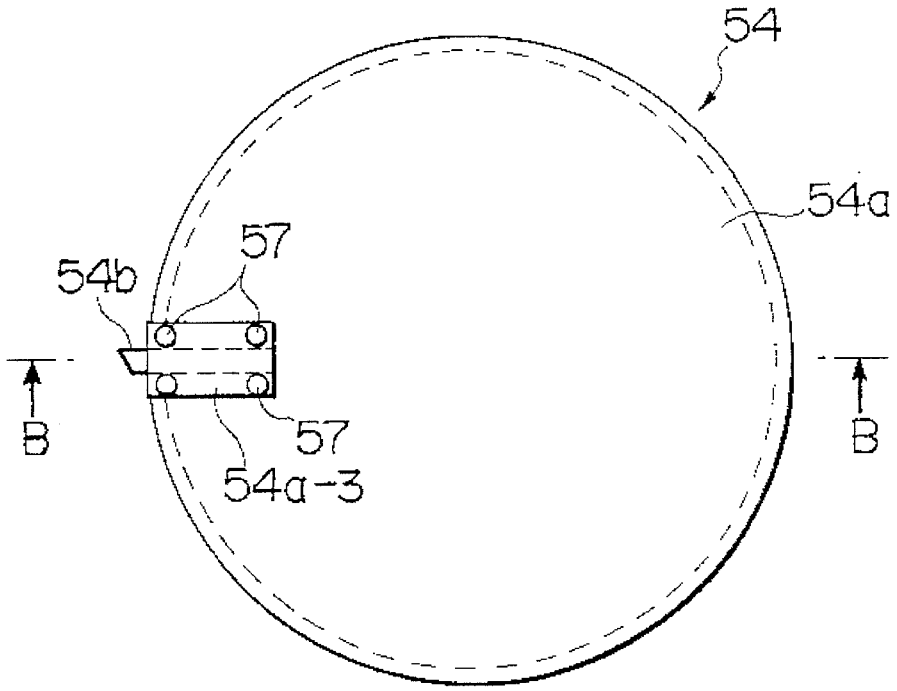
FIG. 13 is a bottom view of a grooving cutter assembly.
Figure 14:
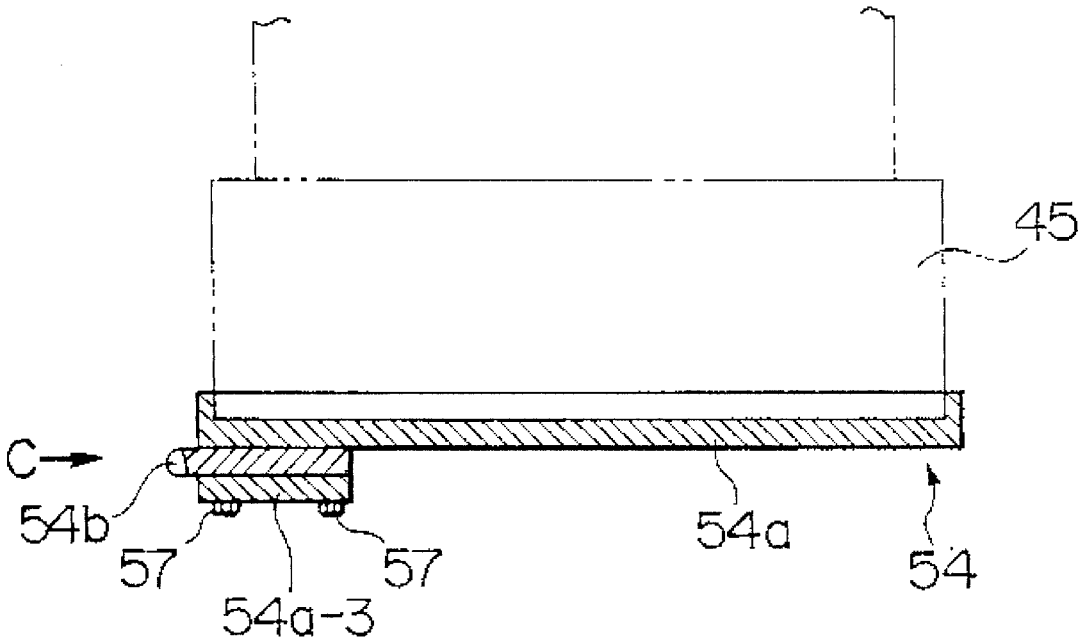
FIG. 14 is a sectional view taken along Line B—B in FIG. 13.
Figure 15:
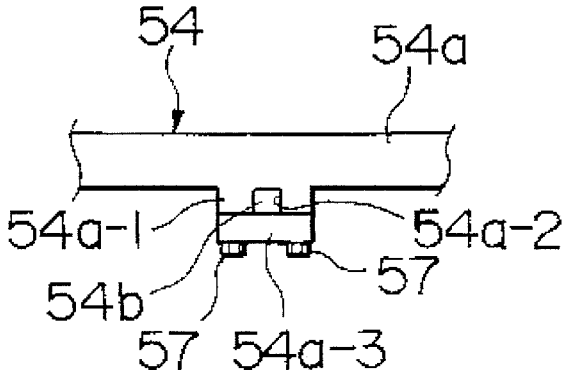
FIG. 15 is a view taken in the direction of an arrow C in FIG. 14.

The grooving cutter assembly 54 will be described with reference to FIGS. 13–15 hereinafter. FIG. 13 is a bottom view of the grooving cutter assembly 54. FIG. 14 is a sectional view taken along Line B—B in FIG. 13. FIG. 15 is a view in the direction of the arrow C in FIG. 14.

As best shown in FIG. 13, the grooving cutter assembly 54 comprises a disc 54*a* sucked by the suction table 45, a holder 54*a*-1 projecting from the underside of the disc 54*a*, a cemented carbide tipped tool 54*b* fitted into a groove 54*a*-2 defined in the holder 54*a*-1, and a cover 54*a*-3 covering the underside of the cemented carbide tipped tool 54*b* and fixed by the bolts 57 to the underside of the holder. As best shown in FIG. 13, the tip of the cemented carbide tipped tool 54*b* extends radially from the edge of the disc 54*a*.

When the air cylinder assembly 49 extends the piston rod 49*a* to rotate the arm 41 about the pivot 43 counterclockwise in FIG. 6, until the side of the rear end of the arm 41 contacts the stopper 51, the cemented carbide tipped tool 54*b* bites the buff 46 by a predetermined depth (i.e. a depth by which the cemented carbide tipped tool 54*b* can completely shave the old formed grooves 46*a*). In this state, the driver 47, as shown in FIGS. 10 and 11, moves the buff 46 upwards so that the cemented carbide tipped tool 54*b* shaves an outer surface layer of the buff 46 by the predetermined depth to gradually smooth the outer cylindrical surface 46*b* from the top to the bottom of the buff 46. The piston rod 51*a* of the stopper 51 precisely positions the tip of the cemented carbide tipped tool 54*b* relative to the buff 46 (i.e. provides a precise biting depth in the buff 46).

Figure 16:
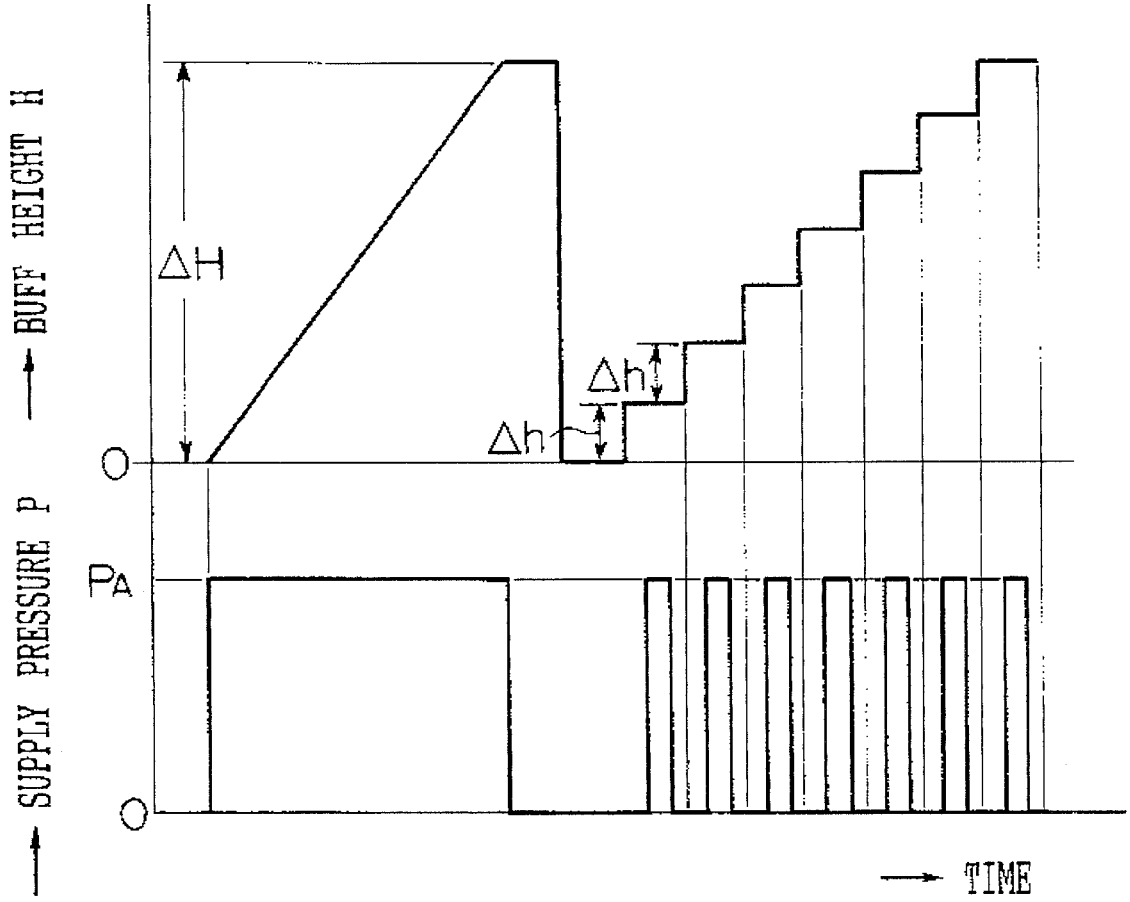
FIG. 16 is a timing chart illustrative of changes with time in the height of the buff and in the pneumatic pressure supplied to the air cylinder assembly.
Figure 17:
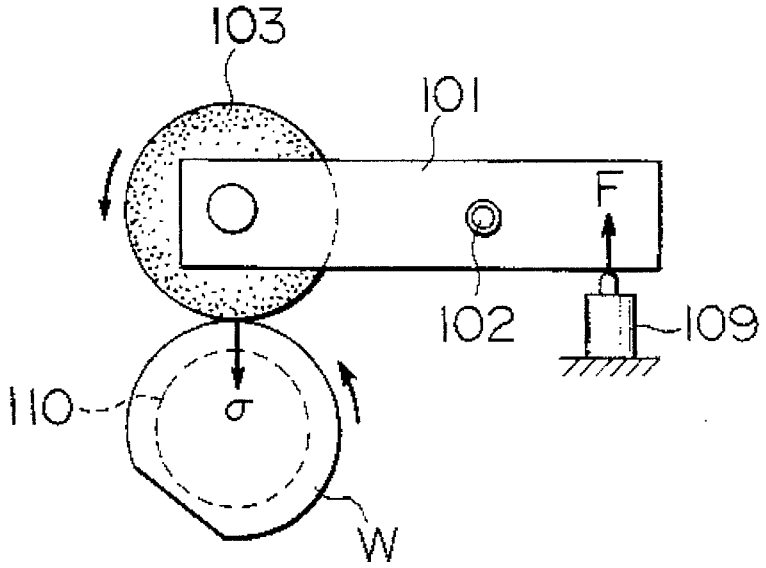
FIG.17 (PRIOR ART)
FIG. 17 is a plan view of a main structure of a prior-art wafer edge bevelling machine.
Figure 18:
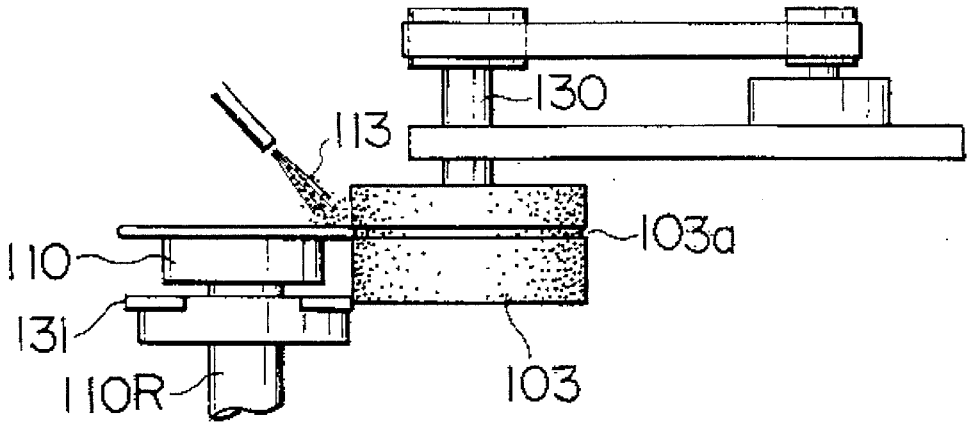
FIG.18 (PRIOR ART)
FIG. 18 is a side elevation of a main structure of a prior-art wafer edge bevelling machine having a cutter for producing a formed-groove in the buff.

A timing chart of FIG. 16 illustrates this operation. That is, FIG. 16 is a graph of changes with time in the height H of the buff 46 and in the pressure of compressed air supplied to the air cylinder assembly 49. In smoothing the outer cylindrical surface of the buff 46, the air cylinder assembly 49 receives a fixed pressure $P_A$, and the driver 47 moves the buff 46 at a predetermined speed by a height difference ΔH between the lower limit and the upper limit of the movement of the buff 46 until the completion of the smoothing. The pressure $P_A$ is so high that the air cylinder assembly 49 precisely positions and rigidly fixes together with the stopper 51 the grooving cutter assembly 54 relative to the buff 46. Thus, the grooving cutter assembly 54 precisely smooth the outer cylindrical surface of the buff 46.

Figure 11:
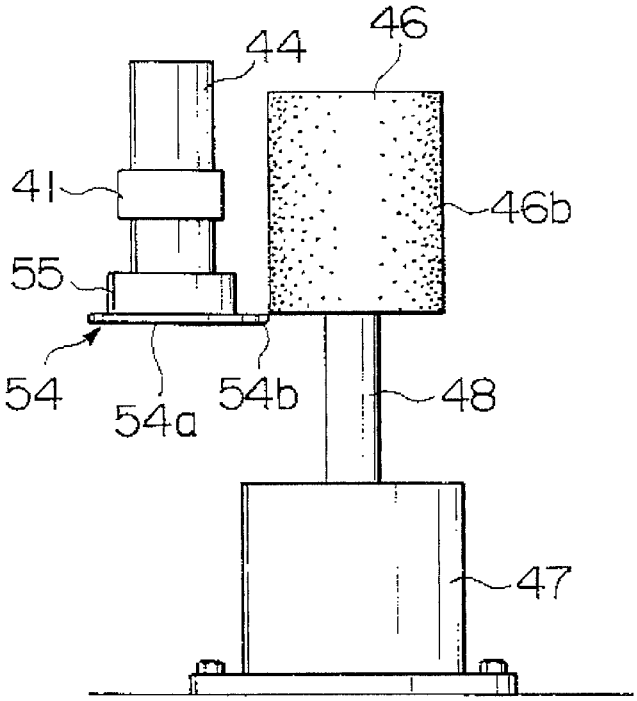
FIG. 11 is the left elevation of the wafer edge bevelling machine, showing the completion of the smoothing the outer cylindrical surface of the buff.

As shown in FIG. 11, when the driver 47 has moved the buff 46 up to the upper limit of the movement of the buff 46 to remove the bottom of the buff 46 from the cemented carbide tipped tool 54*b*, the cemented carbide tipped tool 54*b* completes shaving the old formed grooves 46*a* from the buff 46 to smooth the overall outer cylindrical surface of the buff 46, i.e., renew the outer cylindrical surface of the buff 46.

After the completion of the smoothing, the wafer edge bevelling machine stops supplying the pressure PA to the air cylinder assembly 49 as shown in FIG. 16. The return spring 50 then rotates the arm 41 about the pivot 43 clockwise in FIG. 6. The driver 47 then moves the buff 46 up to the lower limit of the movement of the buff 46 (see FIG. 16).

The driver 47 then moves up the buff 46 by a predetermined height difference Δh (see FIG. 16) and the stopper 51 concurrently contracts a rod 51*a* by a predetermined distance. The air cylinder assembly 49 then receives the pressure $P_A$ again as shown in FIG. 16 to rotate the arm 41 counterclockwise in FIG. 6 by a predetermined angular distance. The cemented carbide tipped tool 54*b* then bites the buff 46 by a predetermined depth and produces a new first formed groove 46A having a predetermined cross section and a predetermined size in the renewed outer cylindrical surface 46*b* of the buff 46 at the bottom end of the buff 46 as the driver 47 rotates the buff 46, as shown in FIG. 12.

After the completion of the production of the first formed groove 46A in the outer cylindrical surface of the buff 46, the wafer edge bevelling machine stops supplying the pressure $P_A$ to the air cylinder assembly 49. The return spring 50 then rotates the arm 41 about the pivot 43 clockwise in FIG. 6 to remove the cemented carbide tipped tool 54*b* from the buff 46. The driver 47 then moves the buff 46 by the predetermined height difference Δh. The air cylinder assembly 49 then receives the pressure $P_A$. The cemented carbide tipped tool 54*b* produces a second new formed groove 46A above the first formed groove 46A.

Thus, repeating the grooving provides a plurality of new annular formed grooves 46A (e.g. seven) arranged axially of the buff 46. These new formed grooves 46A serve to bevel the edge of the wafer W.

In the second embodiment, the buff 46 need not be removed from the output shaft 48 of the driver 47 when the wafer edge bevelling machine originally produces or renews the formed grooves in the buff 46 so that the grooving does not adversely affect the installation precision of the buff 46 to the output shaft 48 of the driver 47. In addition, the stopper 51 precisely stops the rotation of the arm 41 to precisely position the cemented carbide tipped tool 54*b* to precisely determine the biting depth of the cemented carbide tipped tool 54*b* in the buff 46. This insures the precise shaping of the formed grooves 46A.

The suction table 45 sucks the grooving cutter assembly 54 in place only when the wafer edge bevelling machine shapes the formed grooves in the buff 46, so that the grooving cutter assembly 54 is not exposed to the polishing slurry 53. Consequently, the wafer edge bevelling machine eliminates the need for measures for the slurry 53 and the need for the employment of a grooving cutter of an expensive material.

In addition, the suction table 45 can quickly precisely suck and install the grooving cutter assembly 54 in substantially the same manner as the suction table 45 sucks the wafer W, so that the wafer edge bevelling machine can easily efficiently produce the formed grooves 46A in the buff 46.

The present invention is not rigidly restricted to the embodiments described above. It is to be understood that a person skilled in the art can easily change and modify the present invention without departing from the scope of the invention defined in the appended claims.

What is claimed is:

1. An apparatus for bevelling the edge of a wafer, the edge of the wafer including a circular edge having a radius of curvature, an orientation flat separate from the circular edge and having an infinite radius of curvature, and round joints between the circular edge and the orientation flat each having a radius of curvature smaller than the radius of curvature of the circular edge, comprising:

a framework;

a table rotatably mounted to said framework and capable of holding down the wafer;

a buff rotatably mounted to said framework opposite said table and having a formed groove for bevelling the edge of the wafer;

means, mounted to said framework, for pressing said buff to the orientation flat, the circular edge and the round joints of the wafer held down by said table;

a sensor sensing the orientation flat, the circular edge and the round joints of the wafer held down by said table and producing corresponding signals; and a control controlling said pressing means to select different forces in response to the signals and to result in an equal contact pressure on all points of bevelling between the edge surface of the formed groove and the edge of the wafer.

2. The apparatus for bevelling the edge of a wafer as recited in claim 1, wherein said forces comprise a first force by which said pressing means presses said buff on the orientation flat, a second force by which said pressing means presses said buff on the circular edge, and a third force by which said pressing means presses said buff on the round joints, the first, second and third forces having such a relation that the first force is largest, the second force is intermediate and the third force is smallest.

3. The apparatus for bevelling the edge of a wafer as recited in claim 1, wherein said pressing means comprises an air cylinder assembly, said control comprises a pneumatic control circuit and an electronic central processing unit, the pneumatic control circuit comprising a compressed air source and a solenoid operated valve, the solenoid operated valve changing the pressure of compressed air supplied from the compressed air source to the air cylinder assembly into three different pressures in response to the forces under the control of the electronic central processing unit.

4. The apparatus for bevelling the edge of a wafer as recited in claim 2, wherein said pressing means comprises an air cylinder assembly, said control comprises a pneumatic control circuit and an electronic central processing unit, the pneumatic control circuit comprising a compressed air source and a solenoid operated Valve, the solenoid operated valve changing the pressure of compressed air supplied from the compressed air source to the air cylinder assembly into three different pressures in response to the forces under the control of the electronic central processing unit.

5. The apparatus for bevelling the edge of a wafer as recited in claim 1, wherein said sensor comprises a photo-sensor having a pair of a light-emitting element and a light-receiving element arranged opposite each other through the wafer held down by said table.

6. The apparatus for bevelling the edge of a wafer as recited in claim 2, wherein said sensor comprises a photo-sensor having a pair of a light-emitting element and a light-receiving element arranged opposite each other through the wafer held down by said table.

7. The apparatus for bevelling the edge of a wafer as recited in claim 3, wherein said sensor comprises a photo-sensor having a pair of a light-emitting element and a light-receiving element arranged opposite each other through the wafer held down by said table.

8. The apparatus for bevelling the edge of a wafer as recited in claim 4, wherein said sensor comprises a photo-sensor having a pair of a light-emitting element and a light-receiving element arranged opposite each other through the wafer held down by said table.

9. The apparatus for bevelling the edge of a wafer as recited in claim 5, wherein the photo-sensor is positioned relative to said table so that the area of a cross section of a beam of light received by the light-receiving element is largest when the center of the orientation flat passes through a beam of light emitted from the light-emitting element, said signals having voltages proportional to said area.

10. An apparatus for bevelling the edge of a wafer, the edge of the wafer including a circular edge having a radius of curvature, an orientation flat separate from the circular edge and having an infinite radius of curvature, and round joints between the circular edge and the orientation flat each having a radius of curvature smaller than the radius of curvature of the circular edge, comprising:

a framework;

an arm pivotally mounted to said framework;

a table rotatably mounted to one end of said arm and capable of holding down the wafer;

a buff rotatably mounted to said framework opposite said table and having a formed groove for bevelling the edge of the wafer;

a pusher pushing the other end of said arm in a direction of the rotation of said arm in which the one end of said arm approaches said buff;

a grooving cutter assembly capable of being removably held by said table and of producing the formed groove;

a lock locking the rotation of said table when the apparatus for bevelling the edge of the wafer produces the formed groove; and a stopper mounted to said framework and stopping the rotation of said arm, said stopper positioning said grooving cutter assembly relative to said buff in cooperation with said pusher.

11. The apparatus for bevelling the edge of a wafer as recited in claim 10, further comprising:

a return spring urging said arm in a direction of the rotation of said arm in which the wafer held by said table is moved away from said buff; and wherein said pusher comprises an air cylinder assembly having a piston rod in contact with said other end of said arm, and said stopper is opposite said pusher through said arm and movable in the direction of the piston rod, said stopper producing a counterforce having a direction in alignment with the direction of a push of the piston rod.

12. The apparatus for bevelling the edge of a wafer as recited in claim 11, further comprising:

said pusher pushing said arm by different forces to cause said buff to press by substantially the same contact pressure the orientation flat, the circular edge and the round joints of the wafer held down by said table;

a sensor sensing the orientation flat, the circular edge and the round joints of the wafer held down by said table and producing corresponding signals; and a control controlling said pusher to select between said forces in response to the signals.

13. The apparatus for bevelling the edge of a wafer as recited in claim 12, wherein said forces comprise a first force by which said arm presses said buff on the orientation flat, a second forge by which said arm presses said buff on the circular edge, and a third forge by which said arm presses said buff on the round joints, the first, second and third forges having such a relation that the first force is largest, the second forge is intermediate and the third forge is smallest.

14. The apparatus for bevelling the edge of a wafer as recited in claim 12, wherein said pusher comprises an air cylinder assembly, said control comprises a pneumatic control circuit and an electronic central processing unit, the pneumatic control circuit comprising a compressed air source and a solenoid operated valve, the solenoid operated valve changing the pressure of compressed air supplied from the compressed air source to the air cylinder assembly into three different pressures in response to the forces under the control of the electronic central processing unit.

15. The apparatus for bevelling the edge of a wafer as recited in claim 12, wherein said sensor comprises a photosensor having a pair of a light-emitting element and a light-receiving element arranged opposite each other through the wafer held down by said table.

16. The apparatus for bevelling the edge of a wafer as recited in claim 15, wherein the photo-sensor is positioned relative to said table so that the area of a cross section of a beam of light received by the light-receiving element is largest when the center of the orientation flat passes through a beam of light emitted from the light-emitting element, said signals having voltages proportional to said area.

17. The apparatus for bevelling the edge of a wafer as recited in claim 2, wherein said control determines said forces to produce substantially the same contact pressure on a point of bevelling between the edge surface of the formed groove and the edge of the wafer.

* * * * *